US006377763B2

(12) United States Patent
Sato

(10) Patent No.: US 6,377,763 B2
(45) **Date of Patent: *Apr. 23, 2002**

(54) IMAGE FORMATION APPARATUS HAVING A FUNCTION TO MAKE PROCESSING SPEED FOR IMAGE FORMATION CHANGEABLE

(75) Inventor: Noriaki Sato, Shizuoka-ken (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/500,027

(22) Filed: Feb. 8, 2000

(30) Foreign Application Priority Data

Feb. 10, 1999 (JP) ..... 11-032702

(51) Int. Cl.[7] ..... G03G 15/00
(52) U.S. Cl. ..... 399/49; 399/45; 399/68
(58) Field of Search ..... 399/45, 49, 53, 399/55, 67, 68, 82, 83

(56) References Cited

U.S. PATENT DOCUMENTS 5,486,903 A * 1/1996 Kanno et al. ..... 399/45
5,873,011 A * 2/1999 Takemoto et al. ..... 399/49
6,070,023 A * 5/2000 Kataoka ..... 399/45

* cited by examiner

*Primary Examiner*—Sophia S. Chen
(74) *Attorney, Agent, or Firm*—Fitzpatrick, Cella, Harper & Scinto

(57) ABSTRACT

In an image formation apparatus which slows down fixing speed and processing speed when it forms an image on an OHP transparent sheet, a board, a gloss sheet or the like, an image for measurement is formed on a photosensitive body at ordinary processing speed, the density of the formed image is measured, an image formation condition is determined based on the measured result, and the determined condition is stored as the image formation condition for the ordinary processing speed. The image formation condition for low speed is determined based on the stored image formation condition and a previously stored correction coefficient, thereby making formation of the image for measurement used to determine the image formation condition for low speed unnecessary.

32 Claims, 11 Drawing Sheets

IMAGE FORMATION APPARATUS HAVING A FUNCTION TO MAKE PROCESSING SPEED FOR IMAGE FORMATION CHANGEABLE

BACKGROUND OF THE INVENTION

1. Field of the Invention

The present invention relates to an image formation apparatus which performs a density control operation.

2. Related Background Art

Conventionally, various methods such as an electrophotographic method, a thermal transfer method, an inkjet method and the like are applied as color image formation methods to a color image formation apparatus. In recent years, the image formation apparatus which applies the electrophotographic method has been widely used, because the electrophotographic method is excellent in the points of high speed performance, high image quality performance and silence performance as compared with other methods. It should be noted that the electrophotographic method includes various kinds of methods. Here, an example of a color image formation apparatus which applies a tandem method especially excellent in the high speed performance will be described.

FIG. 11 is a schematic diagram showing the color image formation apparatus which applies the tandem method. In the image formation apparatus of the tandem method, a toner image formation unit 8K for black, a toner image formation unit 8M for magenta, a toner image formation unit 8C for cyan and a toner image formation unit 8Y for yellow are independently disposed. An image-transferred material such as an ordinary sheet, an OHP (overhead projector) sheet or the like on which a toner image is to be transferred is carried by a carrying belt 7 which is extended by a driving roller 5 and subdriving roller 6, and passes the four toner image formation units sequentially. Every time the image-transferred material 1 passes the toner image formation unit, the toner image of the corresponding color is formed or overlaid on the material 1. Finally, a full-color image is formed on the image-transferred material 1.

Hereinafter, the color image formation apparatus which applies the tandem method will be explained in detail. Since the operations of the respective toner image formation units 8K, 8M, 8C and 8K are substantially the same, hereinafter the operation of only the toner image formation unit 8M will be described as an example of the representative. In the unit 8M, first, a photosensitive drum 9 which is rotatively driven in the direction indicated by the arrow is uniformly electrified at −600V by an electrifier 10 (hereinafter such a potential is called an electrification potential), and a latent image corresponding to a magenta image is formed on the drum 9 by a scan beam of a laser exposure optical system 11 or the like. A potential of the latent image formed by exposure with the scan beam is about −200V (hereinafter called an exposure portion potential). On the other hand, a magenta toner which has a certain quantity and was electrified to have a negative polarity is supplied onto a development roller 12, and a development bias is applied to the roller 12. Either a DC bias or a bias obtained by overlaying an AC bias on the DC bias can be used as the development bias. Even in case of either, by setting the DC component of the bias to have an appropriate value between the electrification potential and the exposure portion potential, it is possible to perform the development in which the toner is selectively adhered to the latent image on the photosensitive drum.

The magenta toner image thus formed on the photosensitive drum 9 is electrostatically transferred onto the image-transferred material 1 carried at the speed substantially the same as the rotation speed of the drum 9, by a positive-polarity transfer bias applied to a transfer roller 13.

Similarly, the above processing is performed in the toner image formation units 8C, 8Y and 8K respectively, whereby the toner image of four colors is formed on the image-transferred material 1. Next, the toner image is meltingly fixed to the image-transferred material 1 by a fixing unit 15, and the material 1 is then discharged from the apparatus.

On the other hand, in the color image formation apparatus, if the density of each color and a halftone gradation characteristic change due to change of available environment, change by long-term use and the like, a color tone of an output image changes. Thus, some image density control means have been often provided to prevent such a problem. Conventionally, in the image density control, a density control sequence described as follows is performed after a power supply is turned on, after a sleep (afterheat) state is released, after images of a certain number are output, and the like. Thus, it is possible to always obtain the stable output image. Hereinafter, an example of the image density control sequence will be described.

First, a toner image (i.e., a test patch) having a specific pattern is formed on the photosensitive drum 9 or the carrying belt, and the density of the formed patch is detected by a density sensor 20. As the test patch, a quadrangle pattern of 15 mm×15 mm is often used. As shown in FIG. 12, the density sensor 20 is mainly composed of a light emission element 21 such as an LED or the like, and a light reception element 22 such as a photodiode or the like. Thus, infrared light is irradiated on a pattern P by the light emission element 21, and the diffused light from the pattern P can be detected by the light reception element 22. The reason why the diffused light, rather than the regular reflection light, is used for the detection is that the diffused light is not influenced easily by the gap of an optical axis, the surface state of the background on which the test patch is formed, and the like. Since the reflection light detected by the light reception element 22 one-to-one correlates to the toner image density, the toner image density can be resultingly detected by the density sensor 20.

The image density is controlled on the basis of an image formation condition including the electrification potential of the photosensitive drum, the laser exposure quantity, the development bias and the like. The halftone gradation characteristic is controlled based on an image data conversion table. Thus, the plural patches are formed by stepwise changing such the image formation condition and the image data conversion table. The densities of these patches are detected by the density sensor 20, and the optimum value of the image formation condition is derived from the detected results.

As above, the density of the tentatively formed toner image is detected, and the detected result is fed back, thereby always obtaining the stable image.

Further, in the color image formation apparatus which applies the electrophotographic method, generally, there is the apparatus for which a low-speed fixing mode (or a low speed mode) is prepared to cope with the image-transferred material such as the OHP sheet, a board or the like. In the low speed fixing mode, since the fixing is performed at the speed lower than the ordinary fixing speed, a fixing time can be prolonged. Thus, even if the OHP sheet is used as the image-transferred material, the toner can be sufficiently melted, thereby increasing permeability. Besides, even if the board having a large heat capacity is used, thereby securing satisfactory fixability.

On the other hand, like the above color image formation apparatus, if the distance between the final transfer position (i.e., at the toner image formation unit 8K) and the nip position of the fixing roller is shorter than the length of the image-transferred material, it is impossible to lower the operation speed of only the fixing unit in the low speed mode. Namely, it is necessary to lower the entire speed (processing speed) of the image formation including carrying speed of the image-transferred material, rotation speed of the photosensitive drum, electrification speed, development speed and transfer speed.

Further, there is the color image formation apparatus for which a high resolution mode to decrease the processing speed is prepared so as to increase the image density in the circumference direction of the photosensitive drum. In the mode (i.e., an ordinary mode) of the ordinary processing speed, even if the optimum image formation condition according to the apparatus and its environment is previously determined based on the image density control sequence, such the image formation condition is not the optimum one in the low speed mode, whereby there is a problem that the quality of the image changes.

Further, it is possible in the low speed mode to additionally perform the density control sequence same as in the ordinary mode so as to settle or firm the formed image even in this low speed mode. However, in this case, the frequency of the control increases, and it takes time for the density control because the processing speed is slow, whereby there is a unfavorable problem that the time necessary for the user to wait for image printing seriously increases.

SUMMARY OF THE INVENTION

An object of the present invention is to provide an image formation apparatus and its control method by which the above-mentioned conventional problems can be solved.

Another object of the present invention is to provide an image formation apparatus and its control method which can obtain an image of proper quality without spending time even in a low speed mode.

Still another object of the present invention is to provide an image formation apparatus and its control method which determines an image formation control condition for a low speed mode, on the basis of an image formation control condition in ordinary processing speed.

Other objects and features of the present invention will become apparent from the following detailed description and the attached drawings.

DETAILED DESCRIPTION OF PREFERRED EMBODIMENTS (First Embodiment)

Figure 1:
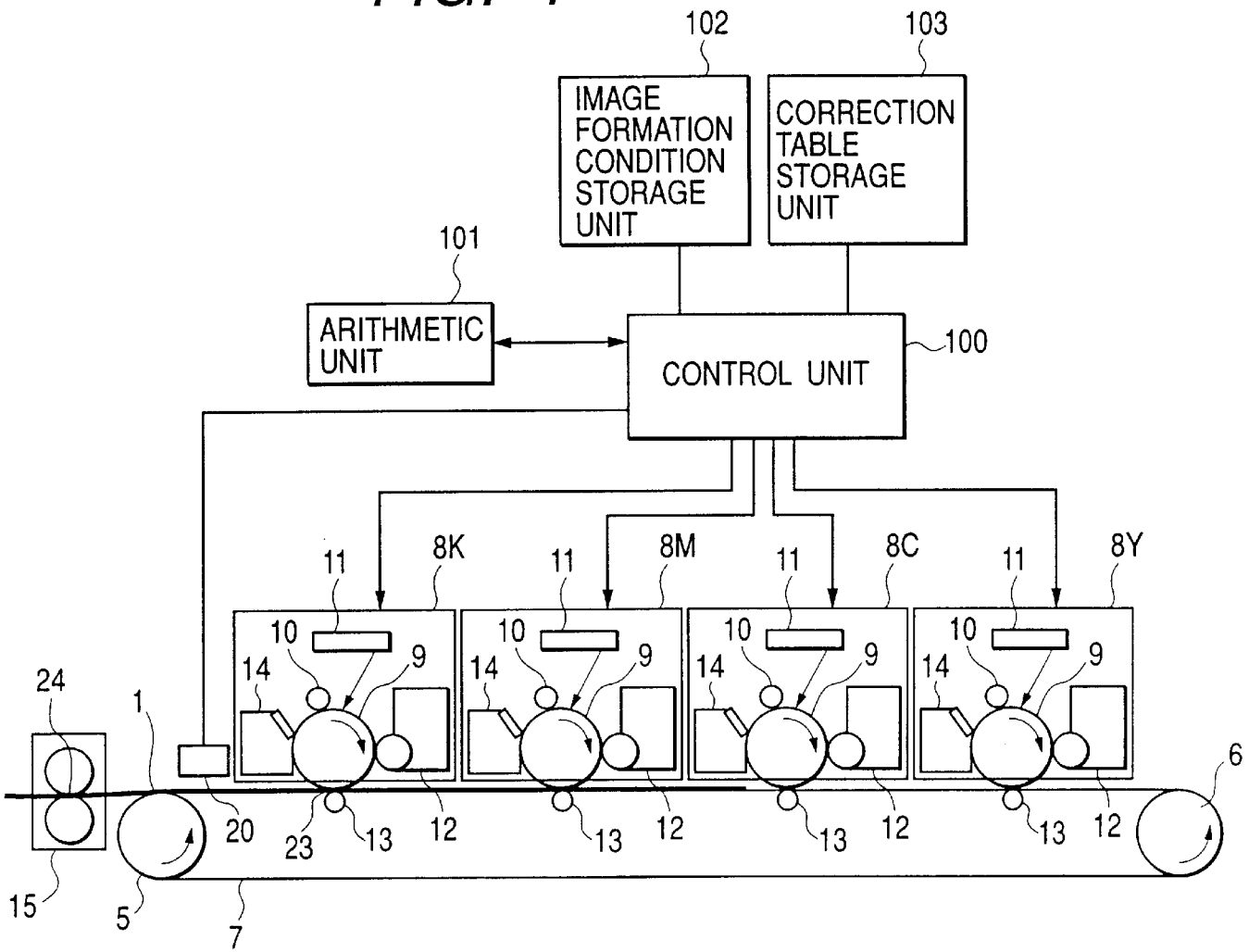
FIG. 1 is a schematic diagram showing an image formation apparatus to which the present invention is applicable.
Figure 11:
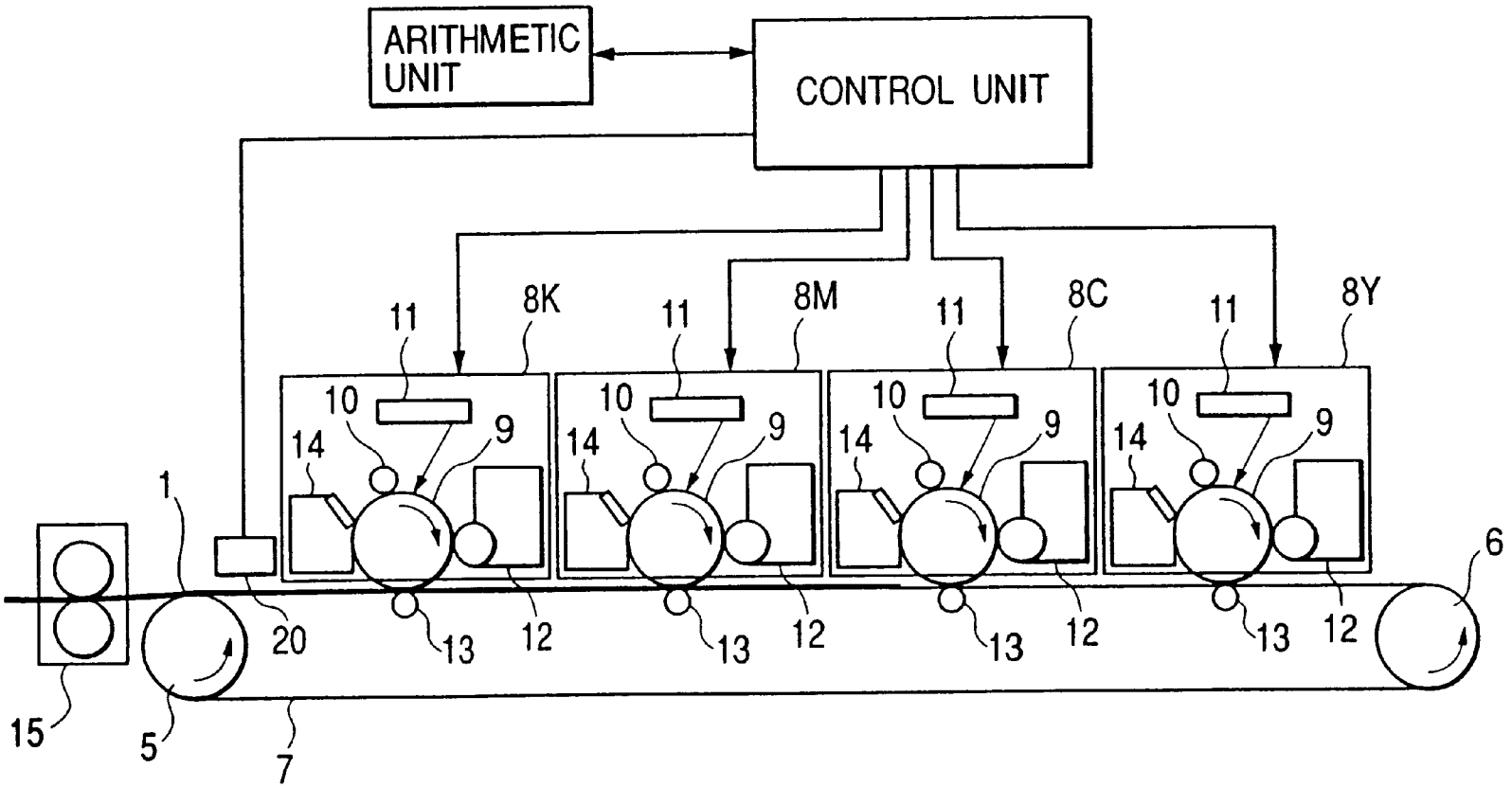
FIG. 11 PRIOR ART
FIG. 11 is a schematic diagram showing a conventional image formation apparatus.
Figure 12:
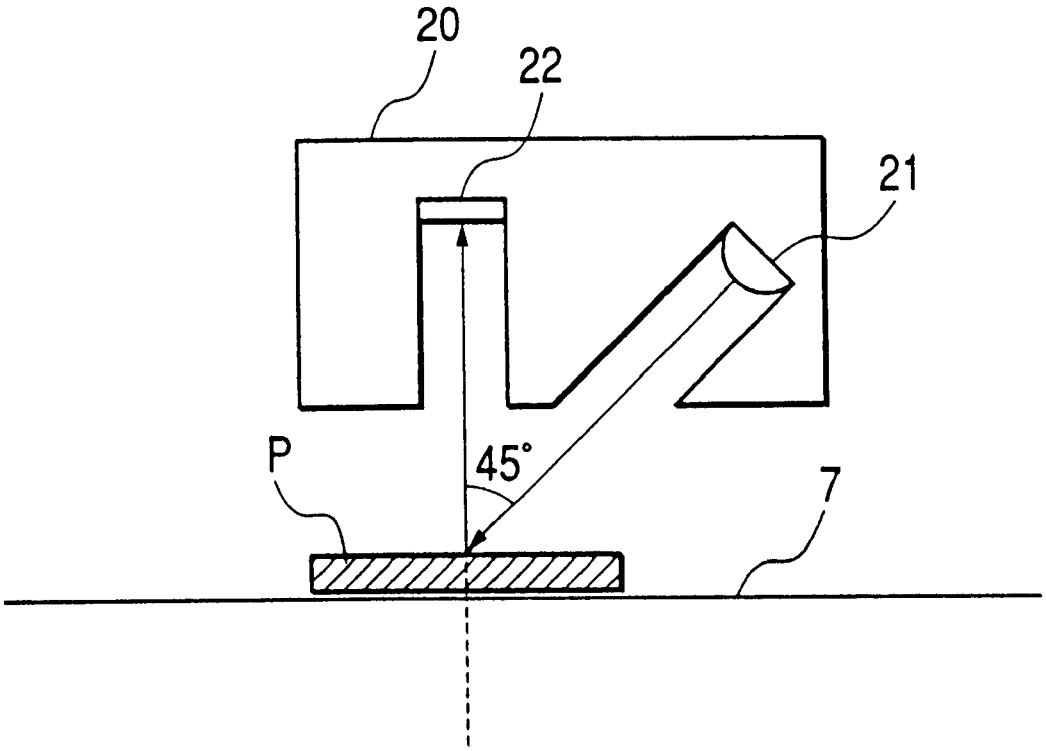
FIG. 12 PRIOR ART
FIG. 12 is a schematic diagram showing a density sensor.

FIG. 1 is a schematic diagram showing an image formation apparatus to which the present invention is applicable. In FIG. 1, the parts having the same structure and function as those in the conventional image formation apparatus shown in FIG. 11 are added with the same reference numerals as those in FIG. 11 respectively, and the explanation thereof will be omitted.

In the present embodiment, in order to downsize the image formation apparatus, the distance between a black transfer position 23 being the final transfer position and a fixing position 24 is set shorter than the length of an image-transferred material 1 of an available minimum size, and processing speed is set low in a low-speed fixing mode (or a low speed mode).

In the present embodiment, like the related background art, an image density control sequence using a test patch is performed in an ordinary mode. Namely, in this mode, an image formation condition including a development bias, an electrification bias, an exposure quantity and the like is determined by the image density control sequence, so as to settle or firm image quality. On the other hand, the condition which is obtained by correcting the previously obtained image formation mode in the ordinary mode is used as the image formation condition in the low speed mode. Thus, the image density control sequence using the test patch is not performed in this mode.

Next, the structure of the image formation apparatus will be explained. In the apparatus, a control unit 100, an arithmetic unit 101, an image formation condition storage unit 102 and a correction table storage unit 103 are disposed. The control unit 100 controls the entire apparatus, and the arithmetic unit 101 determines and corrects the image formation condition. The image formation condition of the ordinary mode for each color which was determined in the density control sequence is stored in the image formation condition storage unit 102. A correction table in which the image formation condition including the development bias, the electrification bias and the like in the low speed mode and the correction value of the image data conversion table are determined for each color is stored in the correction table storage unit 103.

If there are plural kinds of the low speed modes, the correction table corresponding to each mode is prepared. If necessary, the correction table corresponding to each environment and use endurance level may be provided. Besides, the control unit 100 reads the image formation condition of the ordinary mode from the image formation condition storage unit 102, and reads the appropriate correction value of the image formation condition by referring to the correction table on the basis of the condition including the kind of low speed mode, the environment of the low speed mode, the use endurance level and the like. On the basis of the read data, the arithmetic unit 101 performs the operation to correct the image formation condition, and calculates the image formation condition for the low speed mode.

Instead of the correction table, an expression which is to correct the image formation condition for the low speed mode with use of the environment, an endurance deterioration level, the kind of low speed mode and the like as parameters may be used.

Next, how the image formation condition for the low speed mode differs from the image formation condition for the ordinary mode and how the image formation condition for the low speed mode is corrected will be explained.

If the processing speed is decreased in the low speed mode, the time from electrification for a photosensitive drum 9 by an electrifier 10 to latent image formation and development becomes long, whereby dark attenuation of the electrification potential increases. For this reason, it is first necessary to perform the correction of the electrification bias in which the attenuation is added. Besides, since the identical position on the photosensitive drum stays long at the development position and thus development efficiency increases, it is necessary to perform the correction of the development bias.

Figure 2:
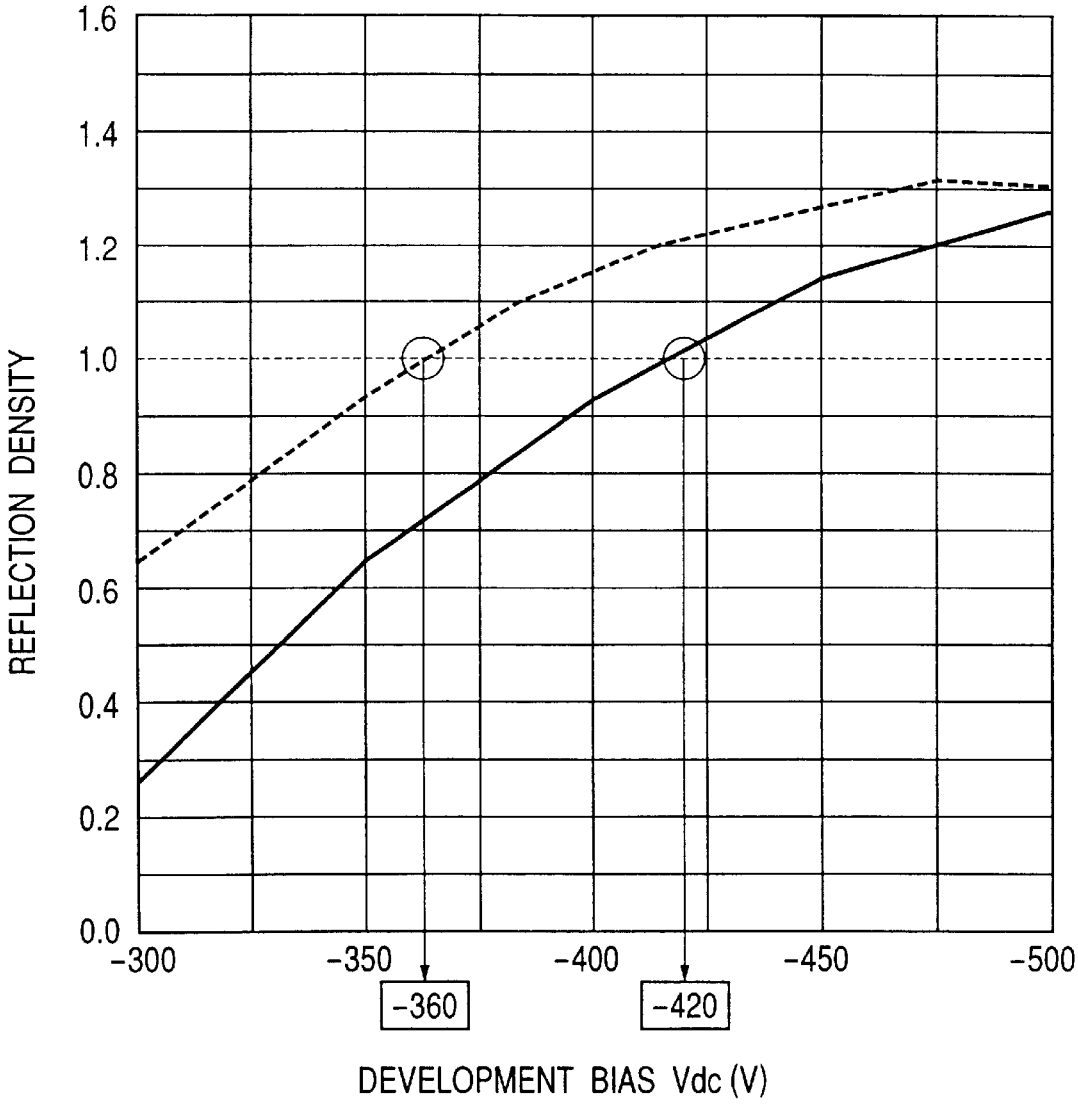
FIG. 2 is a view showing changes of a development bias and an image density.

The method to correct the development bias will be explained in detail. FIG. 2 is a view showing a change of an image density in a case where a 9/16 halftone latent image is developed by the various development biases. The 9/16 halftone latent image is the pattern which is obtained by exposing a 3×3 dot part in a 4×4 dither pattern. In FIG. 2, the solid-line curve represents the result in the ordinary mode, and the dotted-line curve represents the result in the low speed mode in which any correction is not performed. In the present embodiment, the processing speed in the low speed mode is assumed to be ½ at the processing speed in the ordinary mode. It is represented in FIG. 2 that, since the development efficiency is high in the low speed mode, the density in this mode is higher than the density in the ordinary mode. Further, since a decent optical density of 9/16 halftone is 1.0, the development bias corresponding to this density is −420V in the image formation condition of the ordinary mode. On the other hand, in the image formation condition of the low speed mode, the development bias corresponding to the decent optical density is −360V. In order to perform such the correction as above, a correction table as shown in Table 1 is prepared as the correction table for the development bias.

TABLE 1

| | | | | | | | |
|---|---|---|---|---|---|---|---|
| Development Bias In Ordinary Mode | . . . −390 | −400 | −410 | −420 | −430 | −440 | . . . |
| Correction Quantity | . . . 70 | 66 | 63 | 60 | 57 | 55 | . . . |

It is known from Table 1 that, if the development bias in the ordinary mode is −420V, the correction quantity is 60V. Thus, by calculating the development bias in the ordinary mode and the correction quantity, the development bias −360V for the low speed mode can be obtained.

Figure 3:
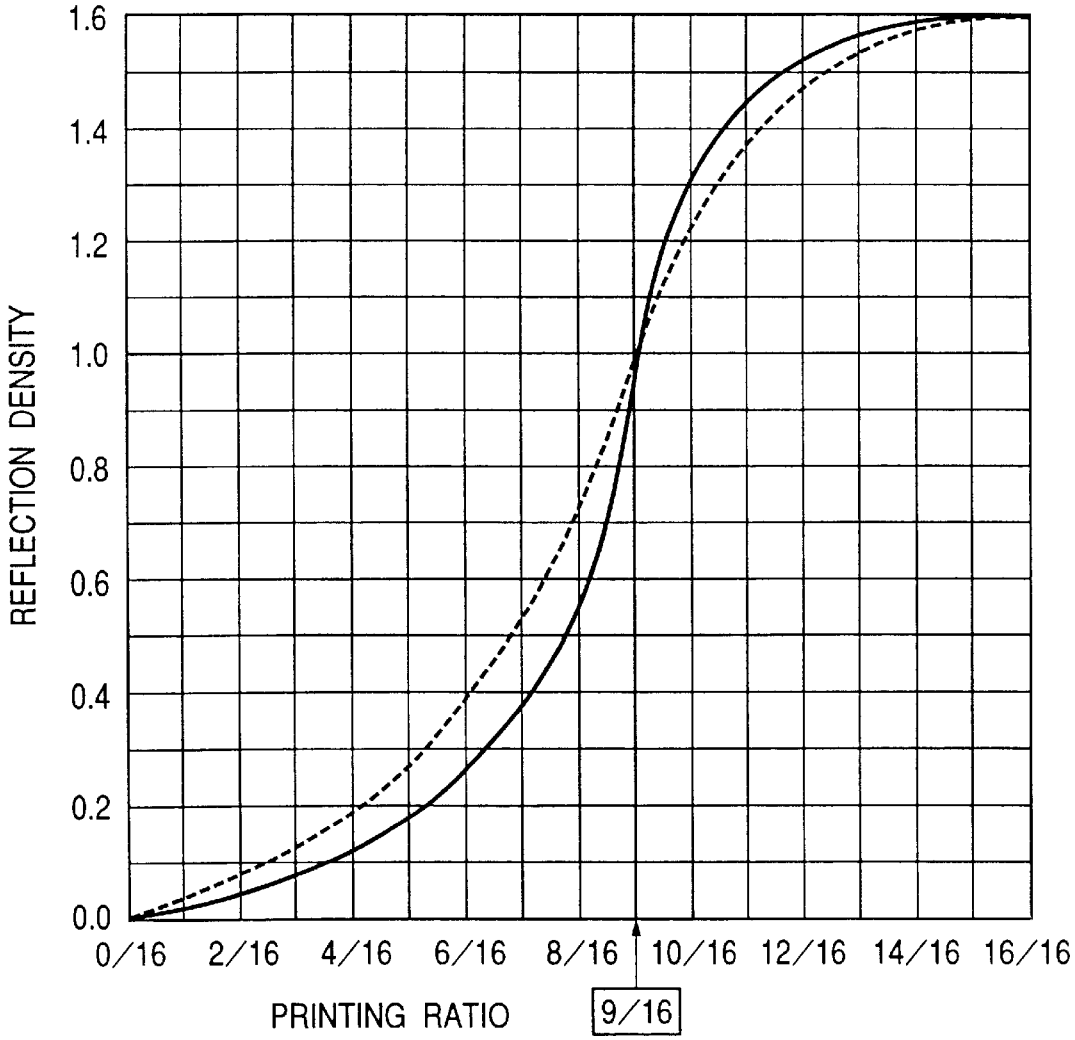
FIG. 3 is a view showing halftone gradation characteristics.

FIG. 3 shows halftone gradation characteristics. The halftone gradation characteristic is the image density change at the time when halftone exposure area ratio of the decent development bias in each of the ordinary mode and the low speed mode is changed. In FIG. 3, the solid-line curve represents the result in the ordinary mode, and the dotted-line curve represents the result in the low speed mode in which any correction is not performed. As shown in FIG. 3, since the halftone gradation characteristic in the ordinary mode is different from that in the low speed mode, it is necessary to change the image data conversion table to correct these characteristics to have a decent value. In the present embodiment, the change of another image formation condition such as the above electrification potential or the like is forecasted, and the correction value thus obtained is prepared on the correction table.

As described above, the image formation condition for the low speed mode is calculated and obtained from the image formation condition for the ordinary mode which is obtained in the density control, by using the correction table or the correction expression according to the environment, the endurance level, the kind of low speed mode (for the board, the OHP sheet, or a gloss sheet). Thus, it is unnecessary to provide the density control sequence requiring a lot of time for the low speed mode, whereby it is possible to reduce user's waiting time, save a quantity of toner consumption, and improve a lifetime of the apparatus.

(Second Embodiment)

The structure of an apparatus in the present embodiment is same as the structure of the apparatus in the first embodiment, and the schematic thereof is shown in FIG. 1. Besides, like the first embodiment, it is necessary to set processing speed low in a low-speed fixing mode (or a low speed mode).

In the present embodiment, a development bias waveform in the low speed mode is set different from a development bias waveform in an ordinary mode to adjust development efficiency which increases in the low speed mode. Since the development efficiency in the low speed mode is set to be substantially the same as that in the ordinary mode, it is possible to make a change of an image formation condition unnecessary according to circumstances. Even if the change of the image formation condition is necessary, it is possible to make such the change smaller. In the case where the image formation condition is corrected as in the first embodiment, if the quantity of the correction is too large, it is not possible occasionally to correct the image formation condition well. The present embodiment is to improve such a drawback.

Figure 4:
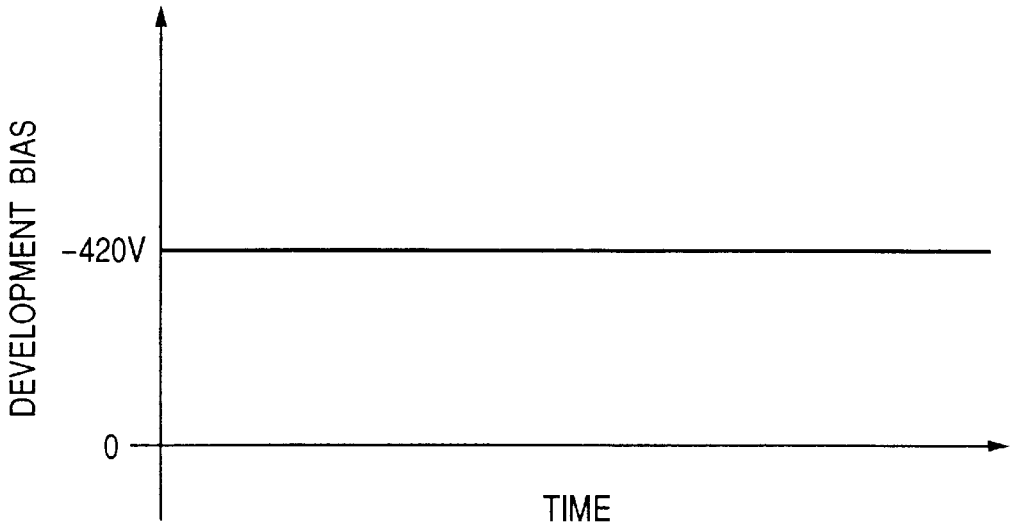
FIG. 4 is a view showing a development bias (DC) in an ordinary mode according to the second embodiment.
Figure 5:
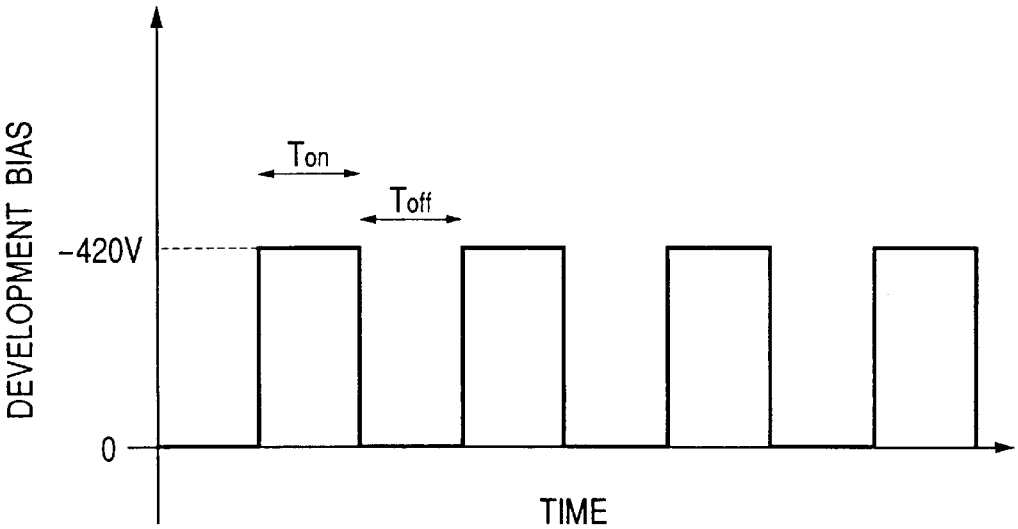
FIG. 5 is a view showing a development bias (DC) in a low speed mode according to the second embodiment.

According to the present embodiment, in the low speed mode, a development bias is turned on and off every certain interval, whereby it is possible to decrease the development efficiency which becomes high in the low speed mode. FIGS. 4 and 5 show concrete examples of such an effect of the present embodiment.

In each of FIGS. 4 and 5, the axis of abscissas is a time base which represents the development bias. FIG. 4 shows the development bias (−420V) in the ordinary mode, and FIG. 5 shows the development bias in the low speed mode.

In the ordinary mode, a ratio between a time (Ton) to turn on the bias and a time (Toff) to turn off the bias and a period while the development bias is turned on and off are optimally determined for each kind of the low speed mode. When the processing speed in the low speed mode is 1/n of the processing speed in the ordinary mode, the ratio between the time Ton and the time Toff is set to be approximately 1:(n−1). It should be noted that, since the period (Ton+Toff) while the development bias is turned on and off is several hundreds of hertz, unevenness is not caused in the image.

Figure 6:
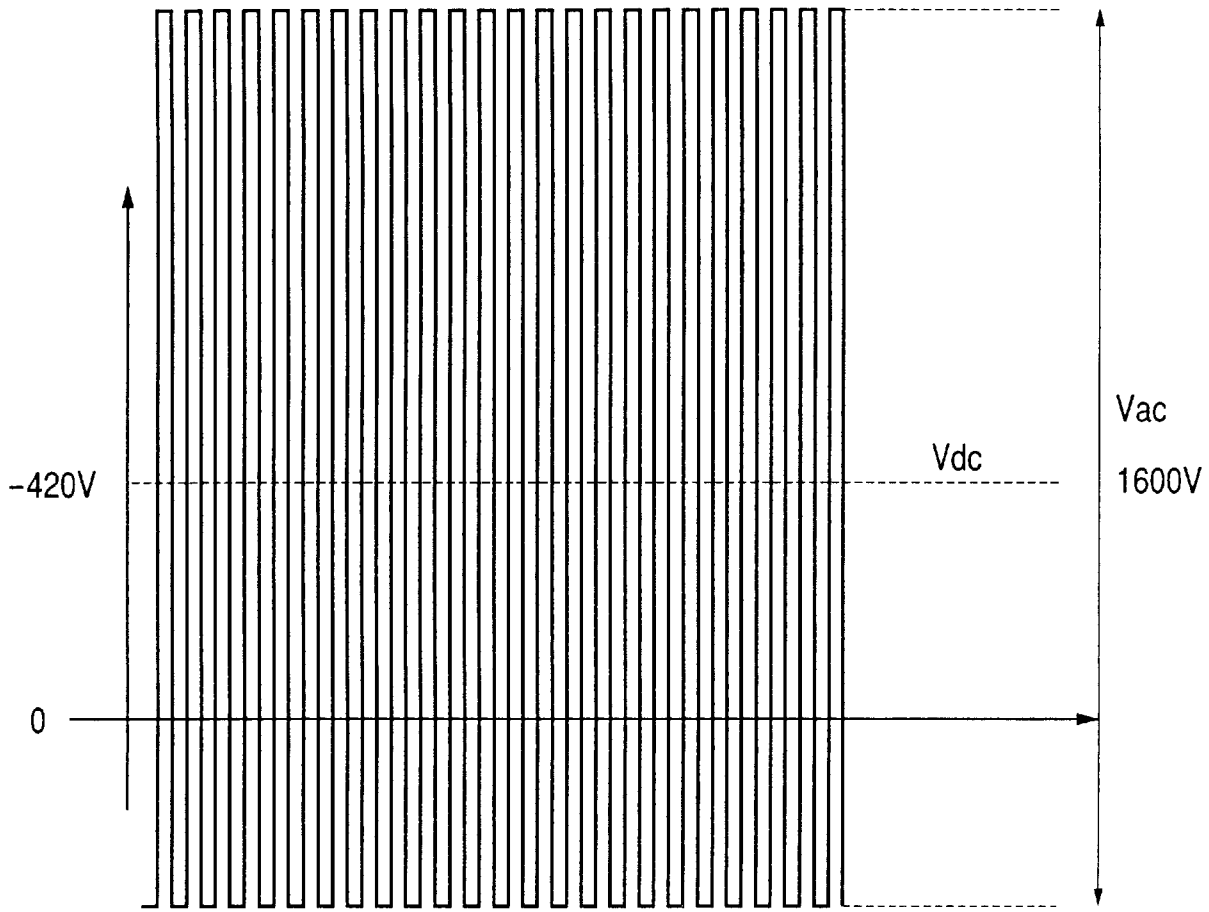
FIG. 6 is a view showing a development bias (AC/DC) in the ordinary mode according to the second embodiment.
Figure 7:
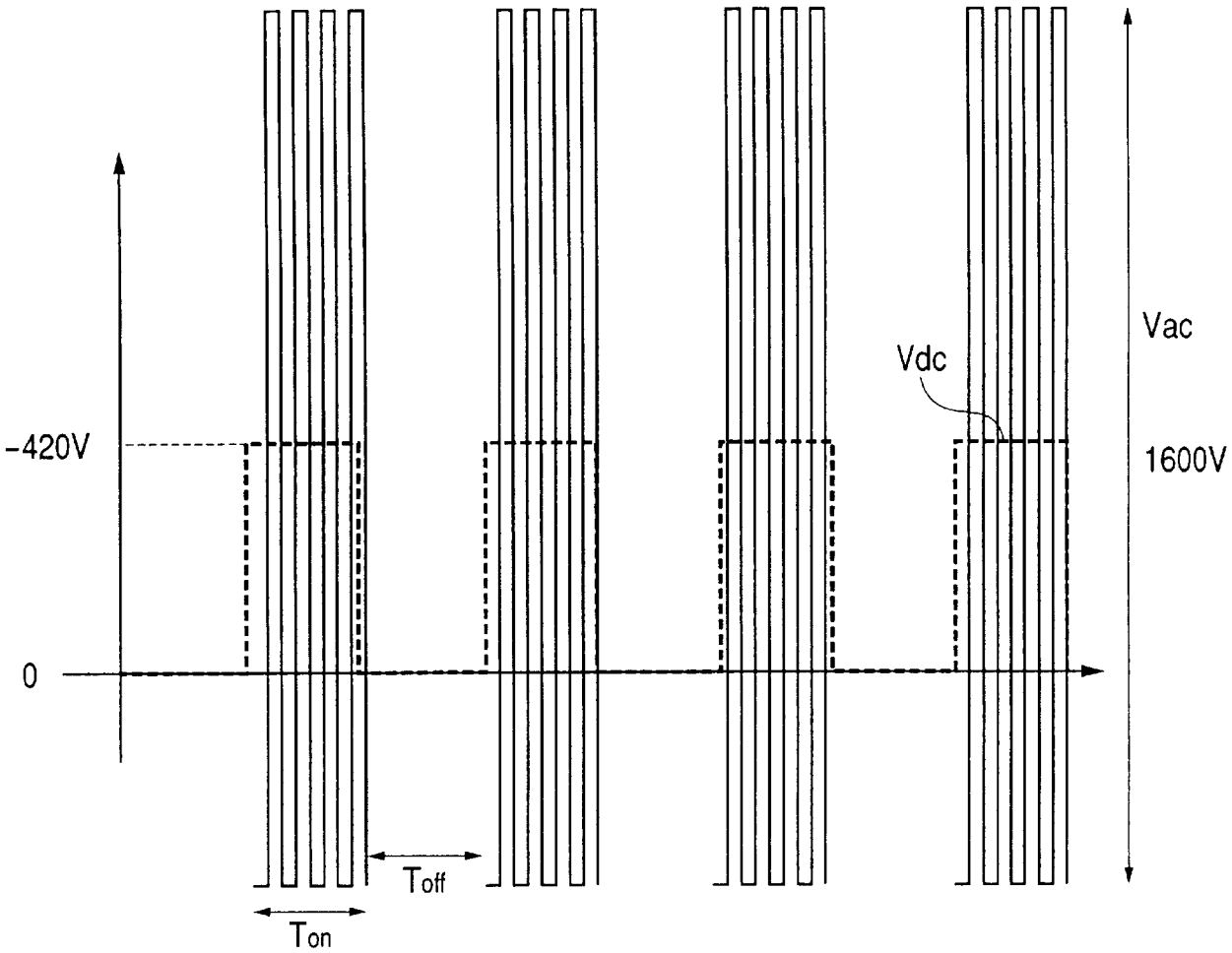
FIG. 7 is a view showing a development bias (AC/DC) in the ordinary mode according to the second embodiment.

FIGS. 6 and 7 show examples in a case where a bias obtained by overlaying an AC bias on a DC bias is used as the development bias. FIG. 6 shows the example in the ordinary mode, and FIG. 7 shows the example in the low speed mode. As an AC component (Vac) of the bias, a peak voltage (Vpp) of 1600V and a frequency of 2 kHz are used.

As a DC component (Vdc) of the bias, the same component as shown in FIGS. 4 and 5 is used. In FIG. 7, both the AC and DC biases are off when the bias is off. However, in this case, only the DC bias may be off.

Figure 8:
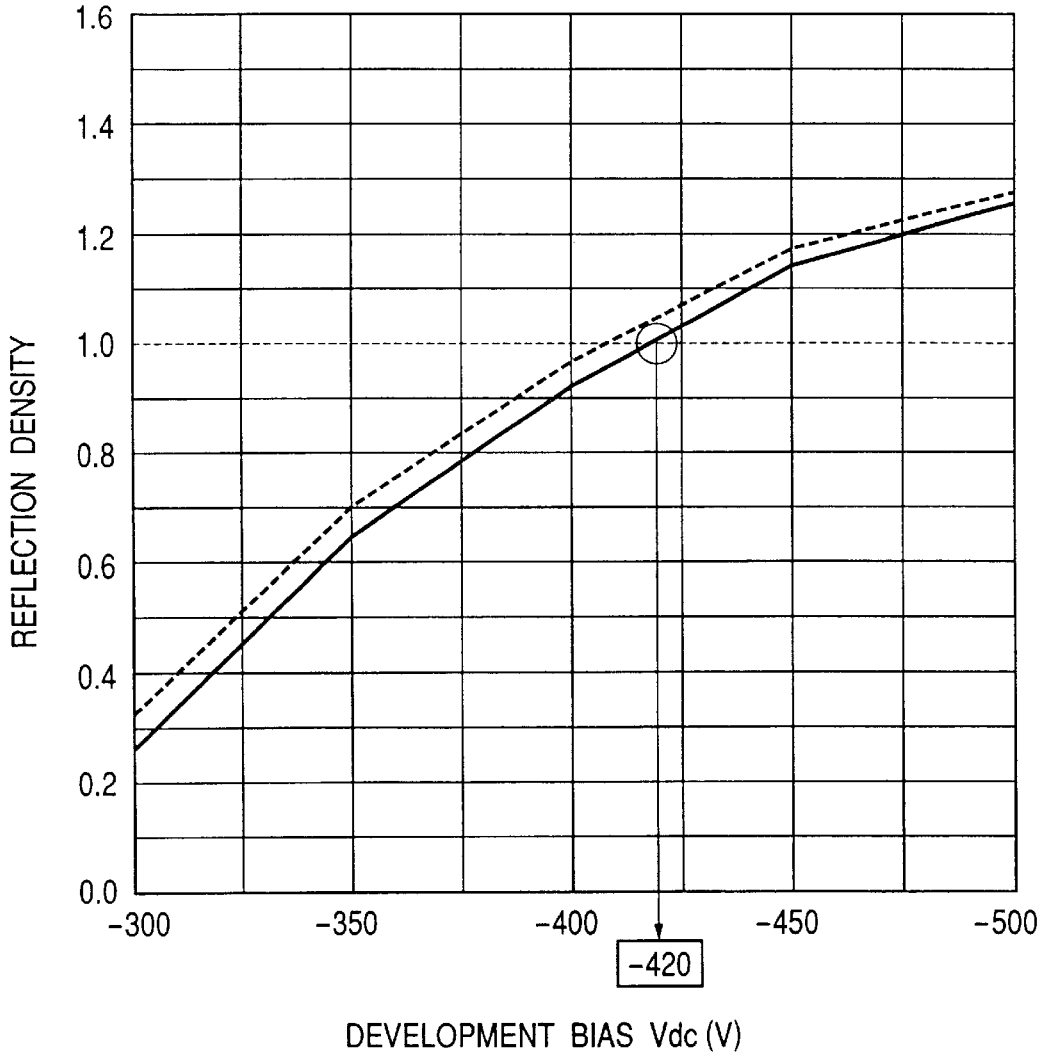
FIG. 8 is a view showing changes of the development bias and an image density according to the second embodiment.
Figure 9:
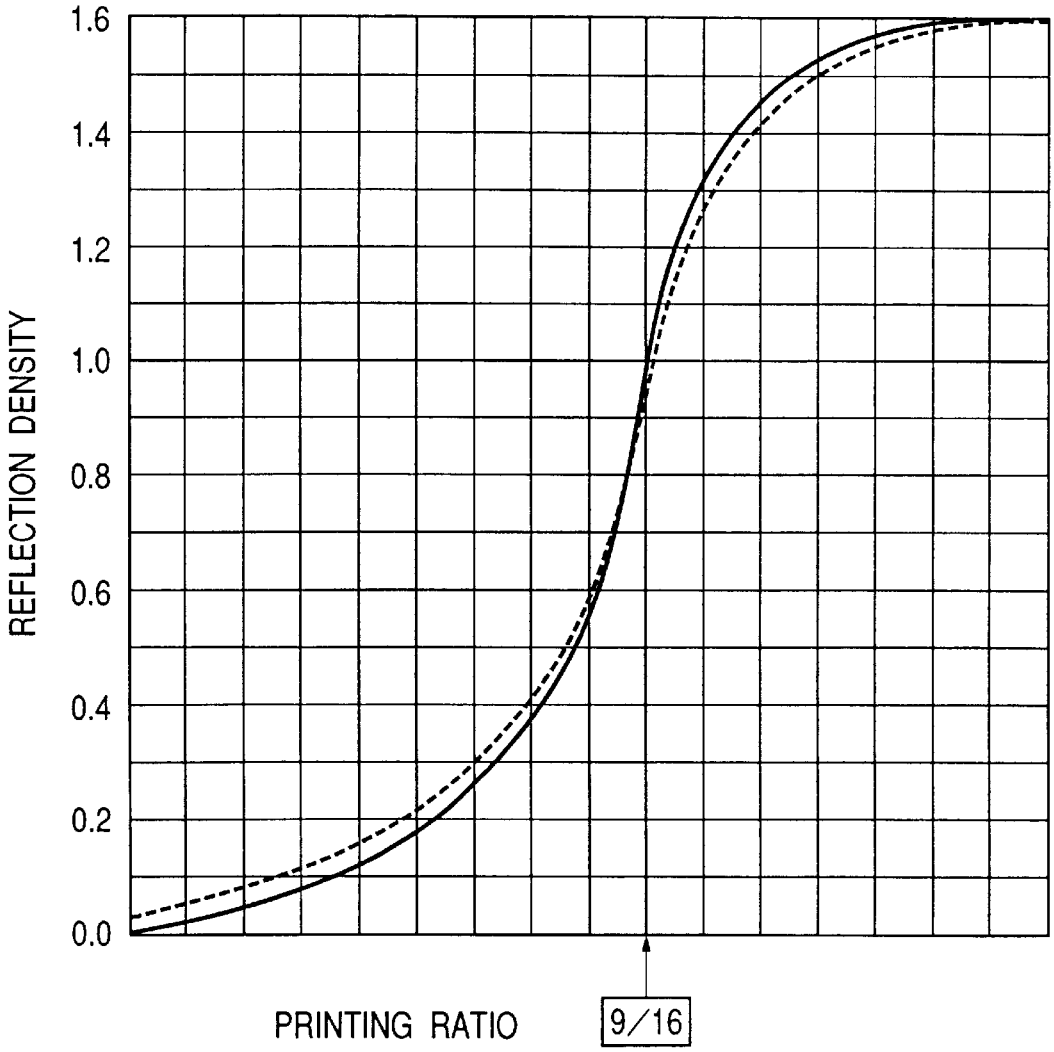
FIG. 9 is a view showing a halftone gradation characteristic according to the second embodiment.

FIGS. 8 and 9 respectively show the values when the density and the halftone gradation characteristic of the low speed mode which are obtained when the development bias is thinned and thus the development time in the low speed mode is brought close to the development time in the ordinary mode as described above are respectively compared with the density and the halftone gradation characteristic of the ordinary mode. If FIGS. 8 and 9 are compared with FIGS. 2 and 3 in the first embodiment, it is understood that the difference between the low speed mode and the ordinary mode in the second embodiment is smaller than that in the first embodiment. Therefore, in the present embodiment, even if the correction of the image formation condition described in the first embodiment is not performed, it is possible to obtain in the low speed mode the substantially decent formed image in the same image formation condition as that in the ordinary mode. Moreover, it is possible to perform such the correction of the image formation condition as described in the first embodiment, so as to correct an image density and a color tone. In this case, since the correction quantity can be made small, it is possible to perform the more accurate correction as compared with the first embodiment.

As above, the example that the bias thinned every certain interval is applied as the development bias for the low speed mode to adjust the development efficiency was described. Besides, the development efficiency may be adjusted by using a bias of various waveform such as sinusoidal waveform, sawtooth waveform, triangular waveform or the like.

As above, like the first embodiment, in the present embodiment, it is unnecessary to provide a density control sequence requiring a lot of time for the low speed mode, whereby it is possible to reduce user's waiting time, save a quantity of toner consumption, and improve a lifetime of the apparatus. Besides, it is possible to omit the correction of the image formation condition. Thus, it is possible to omit an arithmetic unit and a memory, thereby realizing cost decreasing for the apparatus.

(Third Embodiment)

Also, the structure of an apparatus in the present embodiment is same as the structure of the apparatus in the first embodiment, and the schematic thereof is shown in FIG. 1. Besides, like the first embodiment, it is necessary to set processing speed low in a low-speed fixing mode (or a low speed mode).

In the present embodiment, a test patch is actually formed even in the low speed mode, an image formation condition in the low speed mode is determined based on density detection information of the test patch, thereby increasing accuracy of the image formation condition. However, in the above operation, an image formation condition in an ordinary mode is referred to, whereby the number of the test patches can be made smaller than the number of patches formed in an image density control sequence of the ordinary mode. Thus, a time necessary for density control can be shortened.

Hereinafter, a sequence to determine the image formation condition for the low speed mode in the present embodiment will be described in due order.

1. Like the first and second embodiments, the value which is obtained by forecasting the image formation condition for the low speed mode from the image formation condition for the ordinary mode and correcting the forecasted condition is set as a provisional image formation condition for the low speed mode.

2. An experimental patch is formed on a carrying belt in the low speed mode, on the basis of the plural values within a predetermined range expanding from the provisional image formation condition.

3. The density of the experimental patch is detected by a density sensor, the provisional image formation condition is corrected based on the detected density, and the image formation condition for the low speed mode is finally determined based on the corrected provisional image formation condition.

Figure 10:
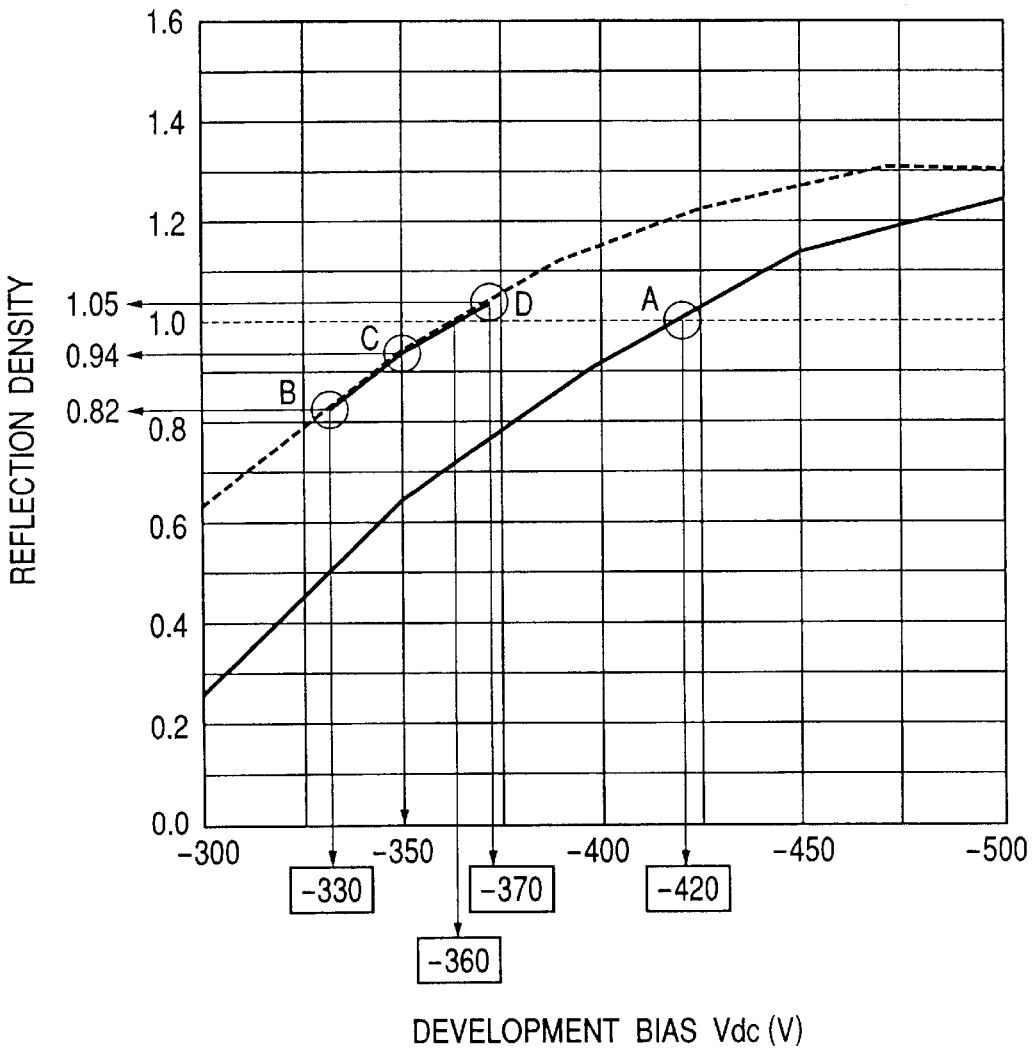
FIG. 10 is a view showing a halftone gradation characteristic according to the third embodiment.

In order to concretize such a method as above, an example to determine a development bias included in the image formation condition will be explained. Like FIG. 2 in the first embodiment, FIG. 10 shows a change of an image density in a case where a 9/16 halftone image patch is output as the development bias is changed. In the present embodiment, since a decent optical density of 9/16 halftone is 1.0, the development bias corresponding to this density is −420V in the image formation condition of the ordinary mode (corresponding to a point A in FIG. 10).

If it first is assumed that −350V is selected as the development bias for the low speed mode according to the provisional image formation condition determined in the above first sequence (corresponding to a point C in FIG. 10). Since the provisional image formation condition is obtained by correcting the development bias for the ordinary mode, it is shown in FIG. 10 that the density in this mode is deviated from the decent optical density 1.0 by a very small quantity (0.06).

In the above second sequence, the test patch in the low speed mode is developed and formed at the development bias −350V and the development biases −330V and −370V respectively apart from the bias −350 to and fro by 20V. Then, in the above third sequence, the density of the test patch is detected. The detected results at the biases −330V, −350V and −370V are 0.82, (corresponding to point B in FIG. 10) 0.94 (corresponding to point C) and 1.05 (corresponding to point D) respectively. Linear interpolation is performed between the adjacent points, and the development bias to have the decent density (1.0) is reversely calculated, whereby it is possible to obtain the more accurate development bias (−360V) for the low speed mode. Thus, the accurate values can be obtained for other image formation conditions in the same manner as above. In this method, the provisional image formation condition is previously calculated, and the optimum image formation condition adjacent to the decent density is searched, whereby it is possible to reduce the number of the test patches experimentally formed.

Besides, since a potential interval of the formed test patch can be made small, it is possible to reduce an error occurred in the linear interpolation, thereby improving accuracy of the decent condition.

As above, since the density control result in the ordinary mode is utilized, it is possible to accurately determine the image formation condition for the low speed mode on the basis of the simple density control as compared with the density control in the ordinary mode.

As explained above, the image density control sequence to actually form the test patch is performed in the ordinary mode, and the image formation condition for the low speed mode is derived from the image formation condition for the ordinary mode obtained in such the sequence, whereby it is unnecessary to perform anew the density control sequence for the low speed mode.

Besides, when the image density control sequence to form the test patch for the low speed mode is performed, the previously obtained image formation condition for the ordinary mode is referred to, whereby it is possible to reduce the number of necessary patches. Thus, it is possible to shorten the time which is necessary for the density control sequence.

As above, the present invention is described with reference to the preferable embodiments. However, the present invention is not limited to the above-mentioned embodiments, and various modifications and applications are possible within the spirit and scope of the appended claims.

What is claimed is:

1. An image formation apparatus which has a function to make processing speed for image formation changeable, comprising:

image formation means for forming an image on an image support body;

density measurement means for measuring a density of the image formed by said image formation means; and control means for causing said image formation means to form plural images for measurement at first processing speed, causing said density measurement means to measure densities of the formed images for measurement, determining an image formation condition at said first processing speed on the basis of the densities measured by said density measurement means, and stores the determined image formation condition in a memory, wherein said control means determines the image formation condition at second processing speed different from said first processing speed, by correcting the image formation condition at said first processing speed stored in said memory.

2. An apparatus according to claim 1, wherein said second processing speed is lower than said first processing speed.

3. An apparatus according to claim 1, wherein said control means causes said image formation means to form the plural images for measurement on the basis of plural values nearby the image formation condition at said second processing speed determined by correcting the image formation condition at said first processing speed stored in said memory, causes said density measurement means to measure the densities of the formed images for measurement, and corrects the image formation condition at said second processing speed previously determined based on the measured densities.

4. An apparatus according to claim 1, wherein said image formation means is composed of latent image formation means for forming a latent image on said image support body and development means for developing the formed latent image, and said control means makes an applying method of a development bias at said second processing speed different from an applying method of the development bias at said first processing speed.

5. An apparatus according to claim 4, wherein said control means turns on and off the development bias at said second processing speed every certain time.

6. An apparatus according to claim 5, wherein, when the ratio of said first processing speed and said second processing speed is 1:n, said control means sets the ratio of on and off of the development bias at said second processing speed to be 1:(n−1).

7. An apparatus according to claim 1, further comprising:

transfer means for transferring the image formed on said image support body, to a recording sheet; and fixing means for fixing the transferred image to the recording sheet, and wherein, in an image formation mode that fixing speed by said fixing means is low, the image formation is performed at said second processing speed.

8. An apparatus according to claim 1, wherein said control means includes a table which stored correction data for correcting the image formation condition at said first processing speed.

9. An apparatus according to claim 7, wherein said image formation mode that the fixing speed is low includes any of a mode to form the image on a board, a mode to form the image on a transparent sheet and a mode to form the image on a gloss sheet.

10. A control method for an image formation apparatus which has a function to make processing speed for image formation changeable, said method comprising:

an image formation step of forming plural images for measurement on an image support body at first processing speed;

a measurement step of measuring densities of the formed images for measurement;

a first determination step of determining an image formation condition at said first processing speed on the basis of the measured densities, and storing the determined condition in a memory; and a second determination step of determining the image formation condition at second processing speed different from said first processing speed, by correcting the image formation condition at said first processing speed stored in said memory.

11. A method according to claim 10, wherein said second processing speed is lower than said first processing speed.

12. A method according to claim 10, further comprising a third determination step of causing said image formation step to form the images for measurement on the basis of plural values nearby the image formation condition at said second processing speed determined by correcting the image formation condition at said first processing speed stored in said memory, causing said density measurement step to measure the densities of the formed images for measurement, and correcting the image formation condition at said second processing speed previously determined based on the measured densities.

13. A method according to claim 10, wherein said image formation step is composed of a latent image formation step of forming a latent image on said image support body and a development step of developing the formed latent image, and said second determination step makes an applying method of a development bias at said second processing speed different from an applying method of the development bias at said first processing speed.

14. A method according to claim 13, wherein said second determination step turns on and off the development bias at said second processing speed every certain time.

15. A method according to claim 14, wherein, when the ratio of said first processing speed and said second processing speed is 1:n, said second determination step determined the ratio of on and off of the development bias at said second processing speed to be 1:(n−1).

16. A method according to claim 10, wherein said image formation apparatus comprises:

transfer means for transferring the image formed on said image support body, to a recording sheet; and fixing means for fixing the transferred image to the recording sheet, and wherein, in an image formation mode that fixing speed by said fixing means is low, the image formation is performed at said second processing speed.

17. An image formation apparatus which has a function to make processing speed for image formation changeable, comprising:

image formation means for forming an image;

density measurement means for measuring a density of an image formed by said image formation means; and control means for causing said image formation means to form a first image for measurement at a first processing speed, for causing said density measurement means to measure a density of the first image for measurement, and for determining both a first image formation condition for said first processing speed and a second image formation condition for a second processing speed different from said first processing speed, on the basis of the density obtained by measuring the first image for measurement.

18. An apparatus according to claim 17, wherein said second processing speed is lower than said first processing speed.

19. An apparatus according to claim 17, wherein said control means causes said image formation means to form an image for measurement at said second processing speed in the second image formation condition, causes said density measurement means to measure a density of the formed image for measurement, and corrects the second image formation condition at said second processing speed previously determined based on the measured density.

20. An apparatus according to claim 17, wherein said image formation means is composed of latent image formation means for forming a latent image on an image support body and development means for developing the formed latent image, and said control means makes an applying method of a development bias at said second processing speed different from an applying method of the development bias at said first processing speed.

21. An apparatus according to claim 20, wherein said control means turns on and off the development bias at said second processing speed every certain time.

22. An apparatus according to claim 21, wherein, when the ratio of said first processing speed and said second processing speed is n:1, said control means sets the ratio of on and off of the development bias at said second processing speed to be 1:(n-1).

23. An apparatus according to claim 17, further comprising:

transfer means for transferring an image formed on an image support body to a recording sheet; and fixing means for fixing the transferred image to the recording sheet, and wherein, in an image formation mode when fixing speed by said fixing means is low, the image formation is performed at said second processing speed.

24. An apparatus according to claim 23, wherein said image formation mode when the fixing speed is low includes at least one of a mode to form the image on a board, a mode to form the image on a transparent sheet and a mode to form the image on a gloss sheet.

25. An apparatus according to claim 17, wherein said control means includes a table for deriving the second formation condition data from the first image formation condition for said first processing speed.

26. A control method for an image formation apparatus which has a function to make processing speed for image formation changeable, said method comprising:

an image formation step of forming a first image for measurement at a first processing speed;

a measurement step of measuring a density of the first image for measurement; and a determination step of determining both a first image formation condition for said first processing speed and a second image formation condition for said second processing speed different from said first processing speed, on the basis of the density obtained by measuring the first image for measurement in said measurement step.

27. A method according to claim 26, wherein said second processing speed is lower than said first processing speed.

28. A method according to claim 26, further comprising a step of forming a second image for measurement at said second processing speed in the second image formation condition, a step of measuring a density of the second image for measurement, and a step of correcting the second image formation condition for said second processing speed previously determined based on the density obtained by measuring the first image for measurement.

29. A method according to claim 26, wherein said image formation step is composed of a latent image formation step of forming a latent image on an image support body and a development step of developing the formed latent image, and an applying method of a development bias at said second processing speed is different from an applying method of the development bias at said first processing speed.

30. A method according to claim 29, wherein the development bias is turned on and off at said second processing speed every certain time.

31. A method according to claim 30, wherein, when the ratio of said first processing speed and said second processing speed is n:1, said determination step determines the ratio of on and off of the development bias at said second processing speed to be 1:(n-1).

32. A method according to claim 26, wherein said image formation apparatus comprises:

transfer means for transferring the image formed on an image support body, to a recording sheet; and fixing means for fixing the transferred image to the recording sheet, and wherein, in an image formation mode that fixing speed by said fixing means is low, the image formation is performed at said second processing speed.

* * * * *

UNITED STATES PATENT AND TRADEMARK OFFICE

CERTIFICATE OF CORRECTION

PATENT NO. : 6,377,763 B2
DATED : April 23, 2002
INVENTOR(S) : Noriaki Sato

It is certified that error appears in the above-identified patent and that said Letters Patent is hereby corrected as shown below:

Column 9,
Line 62, “1:n,” should read -- n:1, --.

Column 11,
Line 25, “an image” should read -- a second --;
Line 27, “formed” should read -- second --; and
Line 30, “measured density.” should read -- density obtained by measuring the first image for measurement. --.

Signed and Sealed this

Twenty-ninth Day of October, 2002

*Attest:*

*Attesting Officer*

JAMES E. ROGAN
*Director of the United States Patent and Trademark Office*